US009521894B2

(12) United States Patent
Mahfood et al.

(10) Patent No.: US 9,521,894 B2
(45) Date of Patent: Dec. 20, 2016

(54) DEVICE FOR DISPENSING A SUBSTANCE AND A LIQUID

(71) Applicants: Adam Paul Mahfood, Weston, FL (US); Richard Wetherell, Miami Beach, FL (US)

(72) Inventors: Adam Paul Mahfood, Weston, FL (US); Richard Wetherell, Miami Beach, FL (US)

( * ) Notice: Subject to any disclaimer, the term of this patent is extended or adjusted under 35 U.S.C. 154(b) by 191 days.

(21) Appl. No.: 14/546,528

(22) Filed: Nov. 18, 2014

(65) Prior Publication Data

US 2015/0250289 A1 Sep. 10, 2015

Related U.S. Application Data

(60) Provisional application No. 61/949,095, filed on Mar. 6, 2014.

(51) Int. Cl.

| | |
|---|---|
| ***A45D 34/06*** | (2006.01) |
| ***A45D 40/24*** | (2006.01) |
| ***A45D 40/04*** | (2006.01) |

(52) U.S. Cl.

CPC ..... *A45D 34/06* (2013.01); *A45D 40/04* (2013.01); *A45D 40/24* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,254,803 | A * | 6/1966 | Meshberg | B65D 83/386 222/182 |
| 6,726,016 | B2 * | 4/2004 | Chen | B05B 11/0037 206/581 |
| 7,841,795 | B2 * | 11/2010 | Huang | A47L 13/16 15/244.1 |
| 8,683,642 | B2 * | 4/2014 | Weng | B08B 1/00 15/118 |

* cited by examiner

*Primary Examiner* — David Walczak
(74) *Attorney, Agent, or Firm* — Mark Terry

(57) ABSTRACT

A device for dispensing a substance and a liquid includes a container having a top end opposing a bottom end. The top end comprises an opening and the bottom end defines a bottom wall. The container defines a compartment adapted to receive a substance. An upper portion of the container is adapted to be covered by a cap. The device includes a cap having a mouth for covering an upper portion of the container. The cap also includes a cavity adapted to receive a spray bottle. A spray opening on the cap allows fluid to pass through the cap. The spray bottle is adapted to be received by and held within the cavity of the cap. The spray bottle is refillable and adapted to spray a fluid through a spray hole and through the spray opening on the cap.

16 Claims, 12 Drawing Sheets

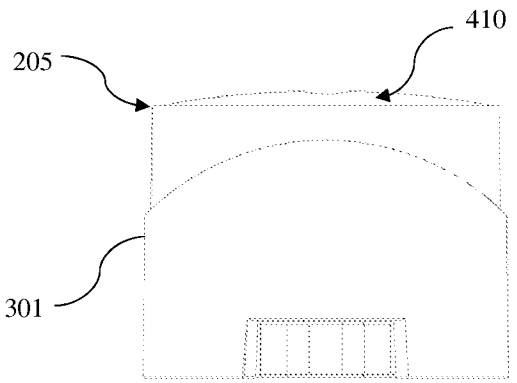
Figure 5A
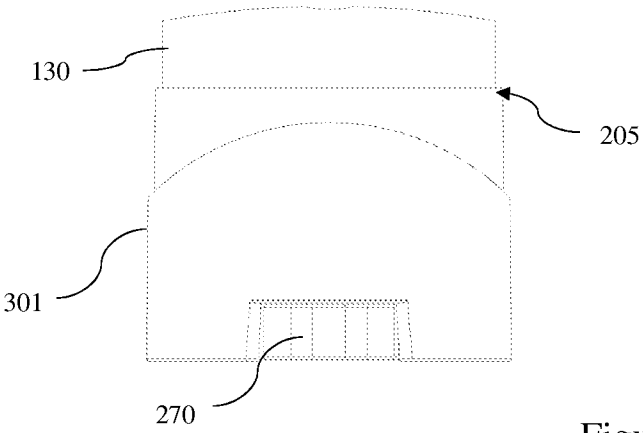
Figure 5B
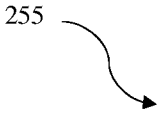

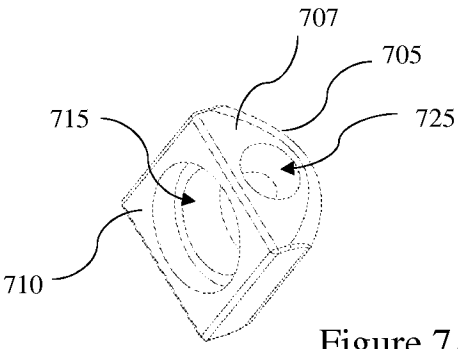
Figure 7A
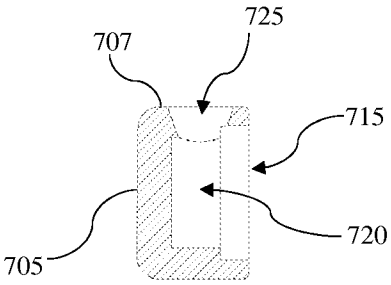
Figure 7C
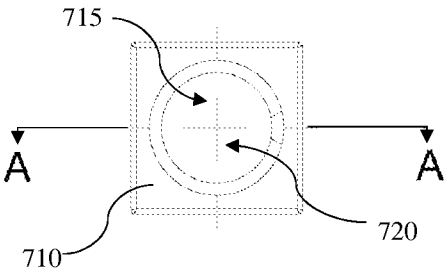
Figure 7B
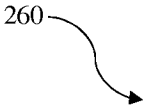

265

DEVICE FOR DISPENSING A SUBSTANCE AND A LIQUID

CROSS-REFERENCE TO RELATED APPLICATIONS

This non-provisional application claims the benefit of U.S. Provisional Application Ser. No. 61/949,095, entitled "DEVICE FOR DISPENSING DEODORANT AND LIQUID SCENTS," filed Mar. 6, 2014. The identified provisional application is incorporated herein by specific reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The disclosed embodiments relate to the field of packaging, and more specifically to the field of packaging cosmetic products.

BACKGROUND

The present invention relates to cosmetic products and more specifically to the packaging of cosmetic products.

Substances such as deodorants and antiperspirants can be applied to the body to reduce body odor caused by perspiration. There are many well known forms of deodorant including a deodorant stick, roll-on, gel, foam and aerosol spray which may be secured in a container. These types of deodorants may be applied to the body such as to the underarm or armpit. However, the deodorant stick may be applied to other parts of the body as well to reduce body odor and possibly to reduce perspiration in the case of an antiperspirant. Additionally, colloids, such as creams, lotions, balms, sun blocks, etc. are well known and can be applied to different parts of the body for cosmetic and health purposes.

Manual liquid, sanitizer, perfume and cologne dispensers of various sorts have been widely implemented in a variety of applications. One type of liquid dispenser is a manually operated pump that is arranged to dispense a liquid, cologne, sanitizer or perfume in a fine mist. A common application for such liquid spray dispensers is well known and used in the dispensing of fragrance.

The current commercial practice is to manufacturer cosmetics, such as deodorants, perfumes, colognes, lotions, suntan lotion, creams etc., and then to package such items in individual packaging. When a person or individual desires to purchase both deodorant and perfume or cologne, then that person will typically purchase two separate items. The first packaging would contain a perfume or cologne and the second packaging would contain the deodorant. This requires a person to make two purchases. Because of the necessity of making two separate purchases, there is a risk that the retailer will run out of stock of one of the products. Additionally, when making two purchases, a consumer or buyer may have difficulty in finding the two separate packages. Furthermore, when traveling, a person is required to store two separate bottles. One for housing perfume or cologne and the other for housing deodorant. Because of the increased amount of space, a consumer or buyer has a reduced amount of space to store other items. Furthermore, because of the increased amount of space utilized for storing two separate packages or containers, a consumer or buyer is not able to easily carry both perfume or colognes and deodorants on their person, such as inside a coat pocket, pants pocket or backpack.

Therefore there exists a need for improvements over the prior art.

SUMMARY

In one embodiment, a device for dispensing a substance and a liquid is disclosed. The device includes a container having a top end opposing a bottom end. The top end comprises an opening and the bottom end defines a bottom wall. The container defines a compartment adapted to receive a substance and an upper portion of the container is the adapted to be covered by a cap. The device also includes a cap having a mouth for covering an upper portion of the container. The cap also includes a cavity adapted to receive a spray bottle. A spray opening on the cap allows fluid to pass through the cap. The device also includes spray bottle, wherein the spray bottle is adapted to be received by and held within the cavity of the cap. The spray bottle is refillable and adapted to spray a fluid through a spray hole. When fully assembled and during operation a fluid can pass from inside the spray bottle to the outside of the cap through the spray opening in the cap.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 5A is a side view of the container of the device having a substance therein in a down position, in accordance with one embodiment of the present invention.

FIG. 5B is a side view of the container of the device having a deodorant therein in an up position, in accordance with one embodiment of the present invention.

FIG. 7A is a perspective view of a crowning member of the device, in accordance with one embodiment of the present invention.

FIG. 7B is a bottom view of a crowning member of the device, in accordance with one embodiment of the present invention.

FIG. 7C is a cross-sectional side view of a crowning member of the device, in accordance with one embodiment of the present invention.

DETAILED DESCRIPTION

The disclosed embodiments improve upon the problems with the prior art by providing a device that is adapted to hold both a liquid, such as a liquid sanitizer, perfume or cologne and a substance, such as a deodorant, cream, lotion, balm, etc. in the form of a solid or colloid. The present invention improves over the prior art by providing a more cost-effective way to store both a liquid and a solid or colloid. Additionally, the present invention reduces the amount of purchases that a person is required to make to purchase both a deodorant and a perfume or cologne. Additionally, the present invention reduces the amount of space required to store both a deodorant and a perfume or cologne. Moreover, the present invention provides a way for a consumer or buyer to store in a sleek and compact manner both a deodorant and a perfume or cologne.

Figure 1A:
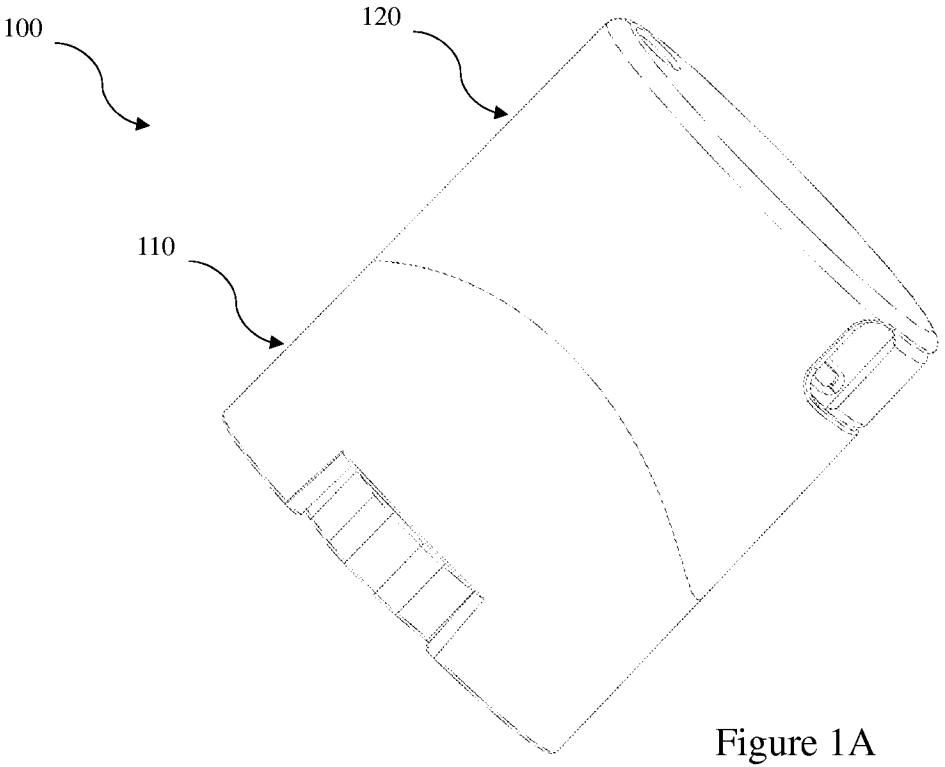
FIG. 1A is a perspective view of a device adapted for dispensing a substance and a liquid, in accordance with one embodiment of the present invention.

Referring now to the Figures, FIG. 1A is a perspective view of the device 100 when fully assembled. FIG. 1A illustrates a device 100 adapted for dispensing a substance and a liquid. In FIG. 1A the device is fully assembled. The device includes a container 110 and a cap 120 adapted to cover an upper portion of the container.

Figure 1B:
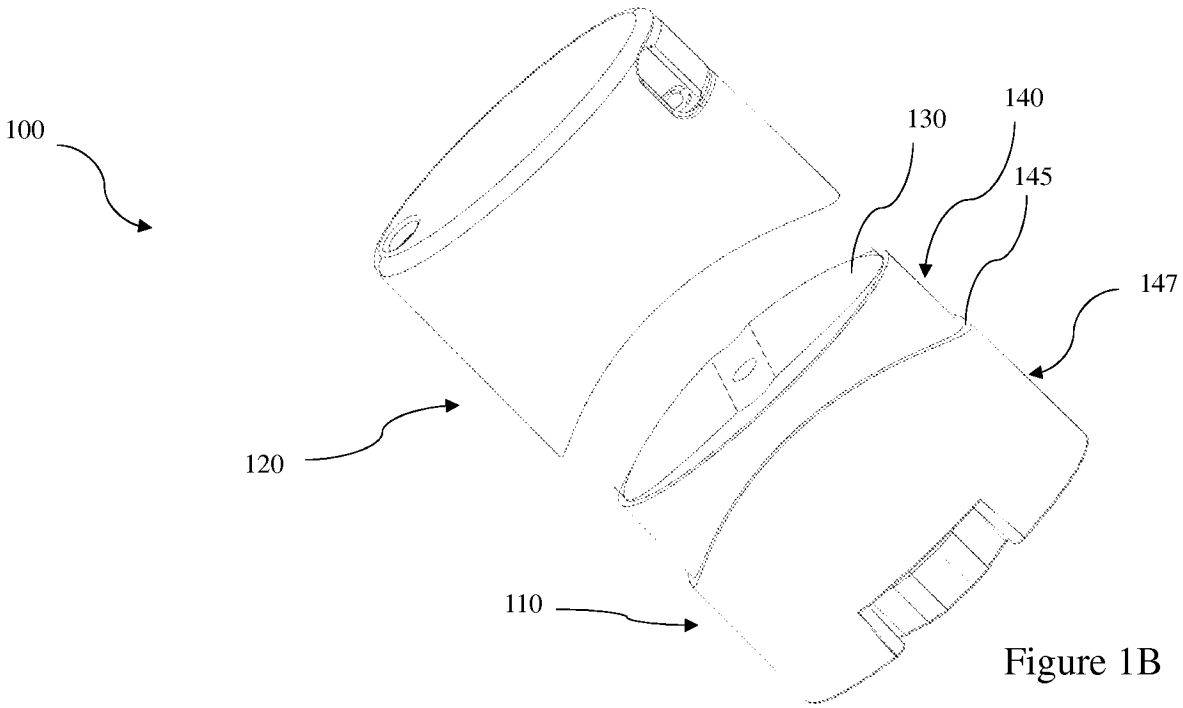
FIG. 1B is a partially exploded perspective view of the device, in accordance with one embodiment of the present invention.

Referring to FIG. 1B, the container has an upper portion 140 substantially tubular in shape. However, other shapes maybe used including a rectangular shape as well as others. In one embodiment, the lower portion 147 of the body 14 can have no contour and can be substantially linear. In other embodiments (not shown), the lower portion can have a contoured shape so that it has a contour design for a better grip by a user. The lower portion of the container also contains enough space so that logos or other advertising material may be displayed on the housing. The logos or graphics may be embedded, etched or carved into the material forming the housing or it may be printed onto the housing. The container and the cap may be formed or molded from plastic, metal, composites etc. The manufacturing of the components of cap and container are well known to those in the art. The components cap and the container may be formed using injection molding, or by extrusion or any other method known in the art.

FIG. 1B also illustrates the cap separated from the container. In FIG. 1B, because the cap is separated from the container, the deodorant stick 130 can be seen. It should be noted that a deodorant stick is not the only type or form of deodorant or colloid that may be used or that may be received inside of the container (explained further below).

Figure 2:
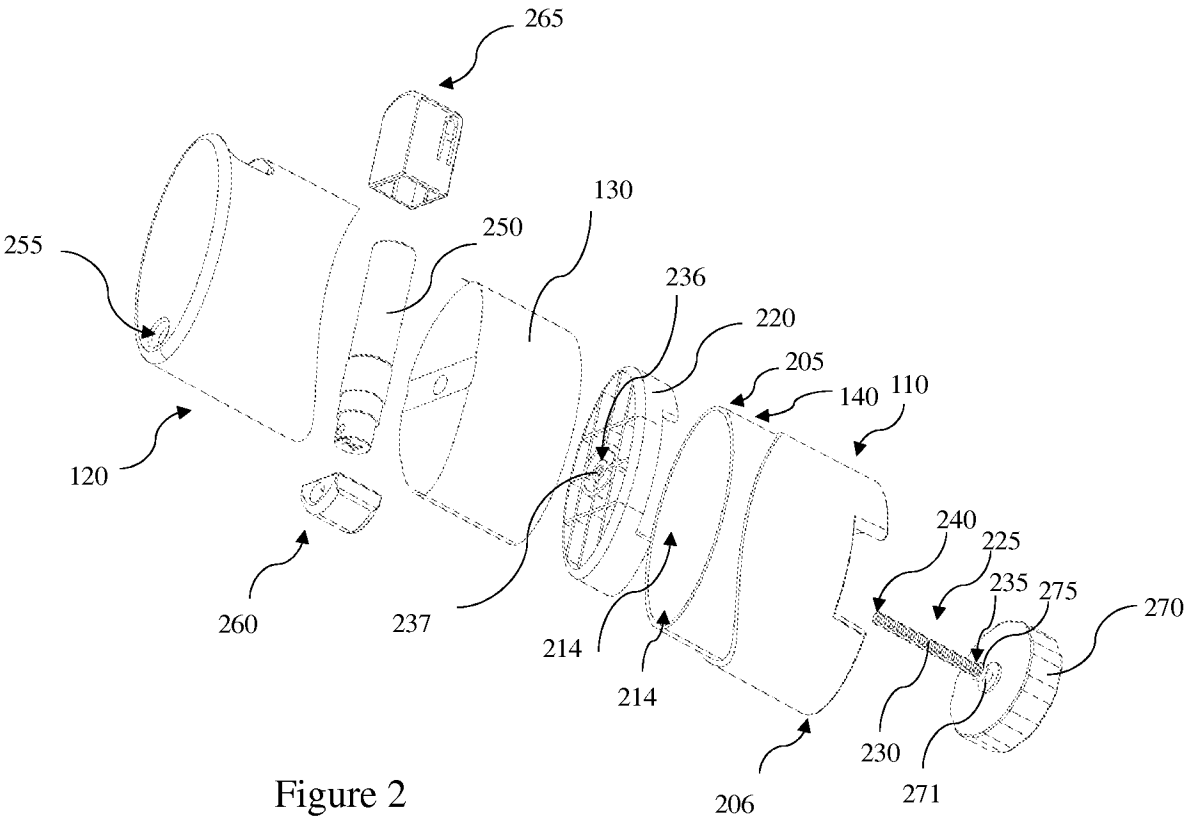
FIG. 2 is an exploded perspective view of the device, in accordance with one embodiment of the present invention.

Referring to FIG. 2, FIG. 2 is a perspective exploded view of the components of the device, in accordance with one embodiment of the present invention. FIG. 2 illustrates the container 110 having a top end 205 opposing a bottom end 206. The top end comprises an opening 214 and the bottom end defines a bottom defining a compartment 215 adapted to receive a substance, such as a stick of deodorant 130 or other colloid or solid, within the compartment of the container.

In the present embodiment, the stick of the deodorant can be lifted up and down by a lifting device. In one embodiment, the lifting device includes a substantially planar lift body 220 adapted to fit within the compartment of the container. The substantially planar lift body 220 defines a substantially elliptical shaped body adapted to fit within the compartment of the container. The lift body has a tubular channel 236 through the center of the body having a plurality of threads 237 matching the threads of a lead-screw.

The lifting device also includes a lead screw 225 defining a shaft 230 having a first end 235 opposing a second end 240 and is adapted for moving the lift body up and down within the compartment of the container. Attached to the first end of the lead screw is a knob 270 allows a user to rotate the lead screw. The lead screw includes a threaded portion having a plurality of threads along the shaft 230 of the lead screw. They lead screw also includes an unthreaded portion 271 proximate to the knob. Separating the unthreaded portion from the threaded portion of the lead screw is a ridge 275 that extends perpendicularly radially outward from the shaft of the lead screw.

FIG. 2 also illustrates the cap 120 for covering the upper portion 140 of the container. The bottom end of the cap defines a mouth that is adapted for receiving the upper portion 140 of the container. The cap has a cavity (illustrated in FIG. 9) that is adapted to receive a spray bottle 250. The spray bottle is adapted to be received by and held within the cavity of the cap. The spray bottle is refillable and is adapted to spray a fluid, such as perfume, cologne etc. through a spray hole of the spray bottle. The fluid emanating from the spray bottle is adapted to pass through a spray opening 255 within the housing of the cap.

FIG. 2 also illustrates the components of a spray bottle assembly (more fully illustrated and explained in the Figures below). The components of the spray bottle assembly include a crowning member 260 and a box shaped member 265 (more fully illustrated and explained in the Figures below).

Figure 3A:
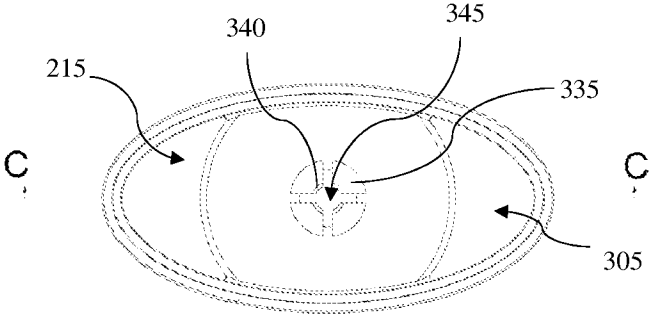
FIG. 3A is a top view of the container of the device, in accordance with one embodiment of the present invention.
Figure 3B:
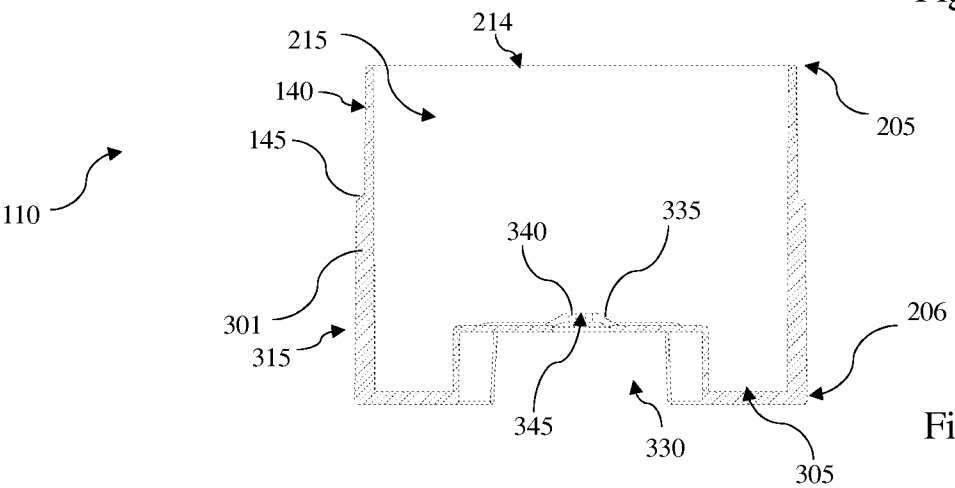
FIG. 3B is a cross-sectional side view of the container of the device, in accordance with one embodiment of the present invention.

FIGS. 3A and 3B provide a more detailed view of the container 110, in accordance with one embodiment of the present invention. FIG. 3A is a top view of the container, in accordance with one embodiment of the present invention. FIG. 3B is a cross-sectional side view taken along line C illustrated in FIG. 3A.

Referring to FIGS. 3A and 3B, the container has a top end 205 opposing a bottom end 206 and a side wall 301 spanning from the top end to the bottom end and a bottom wall 305 at the bottom end. The shape of the container defines a compartment 215 adapted to receive a substance. The substance can be a solid, such as a deodorant, or it may also be a colloid, such as a cream, lotion, suntan lotion etc. The side wall of the container may include an upper portion 140 having an outside cross-sectional diameter slightly less than an outside cross-sectional diameter of a lower portion 147 defining a shoulder 145. The shoulder is adapted to form a stop or ledge upon which the bottom end of the cap 120 may sit when the cap is received by the container.

The bottom end 206 of the container defines a recess 330. The bottom end of the container is adapted to house the lead-screw 225 and knob 270. The recess 330 is adapted such that its cross-sectional diameter is slightly larger than the cross-sectional outside diameter of the knob so that the recess may receive the knob. Within the recess of the bottom wall is an array of cantilevers 335 defining a ring feature 340 surrounding an opening 345. The ring feature defined by the array of cantilevers is adapted to secure the lead-screw and to allow the lead-screw to rotate within the compartment without translating (more fully explained below).

Figure 4A:
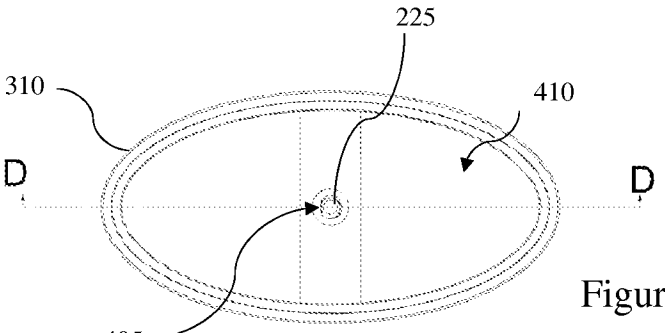
FIG. 4A is a top view of the container of the device having a substance therein, in accordance with one embodiment of the present invention.
Figure 4B:
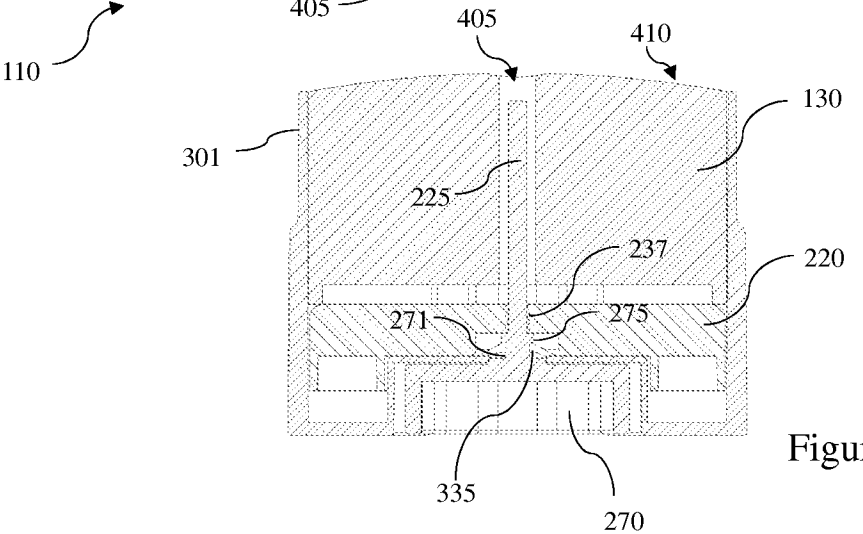
FIG. 4B is a cross-sectional side view of the container of the device having a substance therein, in accordance with one embodiment of the present invention.

FIG. 4A is a top view of the container having a deodorant therein, in accordance with one embodiment of the present invention. FIG. 4B is a cross-sectional side view taken along line D illustrated in FIG. 4A, in accordance with one embodiment of the present invention. FIGS. 4A and 4B illustrate the stick of deodorant held within the compartment 215 and resting on top of the lift body 220. The first end of the lead-screw is attached to the knob 270. The lead screw and knob are positioned in the recess 330 of the bottom end of the container 110 such that the lead-screw is centrally positioned in the compartment 215. The lead-screw is sized such that it can fit within a channel 405 having a tubular shape within the stick of deodorant. The un-threaded portion 271 of the lead-screw is held into place by the ring feature 340 defined by the plurality of cantilevers 235 and is prevented from being removed from the compartment within the container by the ridge 275 that separates the threaded portion of the lead-screw from the un-threaded threaded portion of the lead-screw. In FIG. 4B, the lift body 220 is in the down position proximate to the bottom end of the container. The lift body is a movable between an up and a down position (more fully described below). Deposited on top of the planar shaped lift body is the stick of deodorant. The deodorant may be raised or lowered such that the top end 410 of the deodorant extends beyond the sidewall 301 and top end 205 of the container.

To raise or lower the stick of deodorant a user applies a rotational force to the knob 270 such that it rotates the lead-screw. When the lead-screw is rotated, it is prevented from translating within the body by the ring feature 340, knob 270 and ridge 275. As the lead-screw rotates without translating, the threaded portion of the lead-screw interacts with the threads 237 of the lift body causing the lift body to raise or lower between an up or raised position and a down or lowered position. As lift body is raised or lowered, the stick of deodorant is also raised or lowered allowing a user to apply deodorant to skin.

FIGS. 5A and 5B are side views of the container with the lifting device housed by the container, in accordance with one embodiment of the present invention. FIG. 5A illustrates the substantially planar lift body (not shown) in the fully down position such that the top end 410 of the deodorant 130 cream or other colloid extends slightly above the top end 205 of the container. FIG. 5B illustrates the substantially planar lift body (not shown) in the up position such that the top end of the deodorant extends substantially above the top end of the container. As explained above, in order for the lifting device to lift or lower the stick of deodorant, a user must rotate the knob such that the lead-screw (not shown) rotates within the body without translating causing the threaded portion of the lead-screw to interact with the threaded portion of the channels of the planar lift body (not shown), which results in planar lift body to be raised or lowered depending on the direction that a user rotates the knob.

Figure 6A:
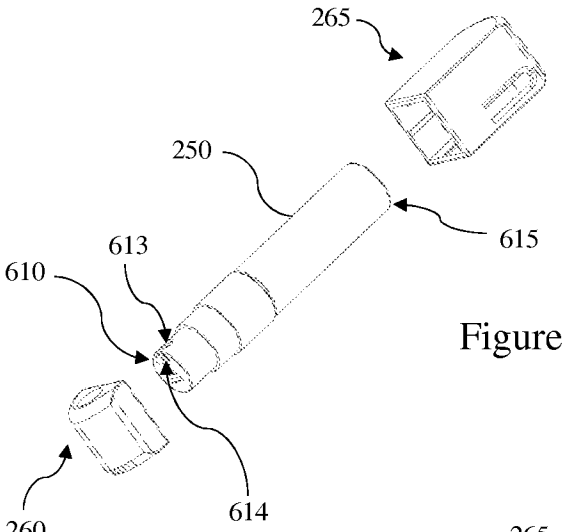
FIG. 6A is an exploded perspective view of a spray bottle assembly, in accordance with one embodiment of the present invention.
Figure 6B:
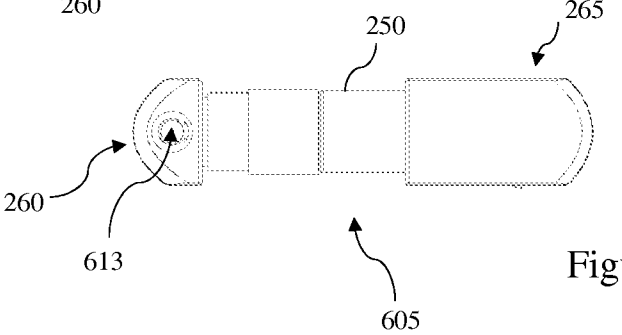
FIG. 6B is a side view of a fully assembled spray bottle assembly, in accordance with one embodiment of the present invention.

FIGS. 6A and 6B illustrate the components of a spray bottle assembly. FIG. 6A is an exploded perspective view of the components of a spray bottle assembly. The components of a spray bottle is assembly include a spray bottle 250, a removable crowning member 260 and a removable box shaped member 265. The spray bottle can have a substantially tubular or cylindrically shaped body having a lower end 615 opposing an upper end 610. The bottle can be varied shaped sizes and is adapted to fit within a cavity 910 (more fully explained below) of the cap 120. Such spray bottles are well known to those skilled in the art (for example, a bottle such as the one disclosed in US patent application number 20090194191 may be used). The spray bottle may be used one time or maybe adapted such that it can be refilled and used multiple times. The spray bottle further includes a spray hole 613 disposed proximate to upper end of the bottle. The top end of the spray bottle may include a depression 614.

The upper end of the bottle is adapted to be received by the crowning member 260 (more fully described in FIGS. 7A-C) and the lower end of the spray bottle is adapted to be received by the box shaped member 265. FIG. 6B is a side view of the fully assembled spray bottle assembly 605 wherein the upper end of the spray bottle is received by a crowning member and the lower end of the spray bottle is received by the removable box shaped member or body. In other embodiments, the components of the fully assembled spray bottle assembly may be integral with one other or may be affixed to each other with glue or some other type of coupling mechanism. The spray hole 613 matches with and corresponds to the second opening (shown as 725 in FIG. 7) of the cap so that the perfume, cologne, sanitizer or other liquid within the bottle may be dispensed through the cap to outside the device.

FIGS. 7A-C provide more detailed views of the crowning member 260. FIG. 7A is a perspective view, in accordance with one embodiment of the present invention. The crowning member comprises a semi-circular shaped hollow body having a curved top end 705 opposing a flat bottom end 710. FIG. 7B is a bottom view of the crowning member, in accordance with one embodiment of the present invention. FIG. 7C is a cross-sectional side view of the crowning member taken along line A of FIG. 7B. The bottom end of the crowning member has a first opening 715 providing access into a crowning member cavity 720, which is defined by the body of the crowning member. The first opening is also adapted for providing the upper end 610 of the spray bottle access into the inside of the crowning member. The crowning member body also has a second opening 725 adapted for fluid to pass through a side wall 707 of the crowning member. A protrusion (not shown) along the inside surface of the front wall of the top end of the crowning member may also be included. Such protrusion matches the depression on the top end of the spray bottle and allows the spray hole of the spray bottle to remain aligned with the second opening of the crowning member and with the spray opening of the cap.

Figure 8A:
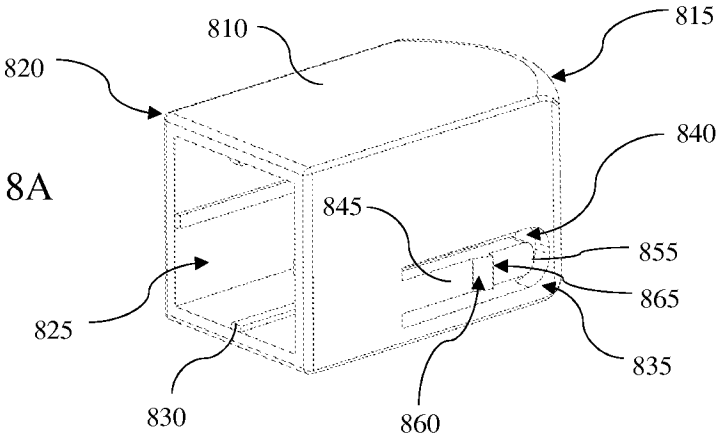
FIG. 8A is a perspective view of a box shaped member of the device, in accordance with one embodiment of the present invention.
Figure 8B:
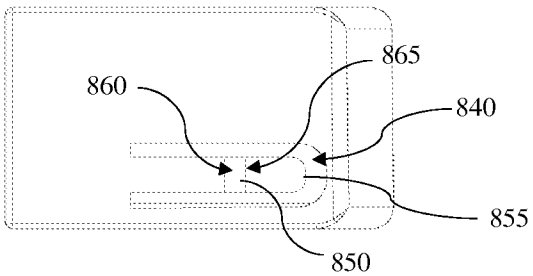
FIG. 8B is a side view of a box shaped member of the device, in accordance with one embodiment of the present invention.

FIGS. 8A and 8B illustrate the box shaped member. FIG. 8A is a perspective view of the box shaped member and FIG. 8B is a side view of the box shaped member, in accordance with one embodiment of the present invention. The box shaped member comprises a rectangular shaped box 810 having a curved bottom end 815 opposing a top end 820 having a box opening 825 providing access into the inside of the rectangular shaped box. Along the sides of the inside of the box shaped member are at least one elongated ridge 830 that extends perpendicularly inward. In the present embodiment, along the inside of each side, one elongated ridge spans from the top end of the box shaped member to proximate to the bottom end of the box shaped member. In the present embodiment, each elongated ridge is rectangular in shape, however other shapes may also be used. Each of the elongated ridges are substantially the same size such that when the lower end of the spray bottle is inserted into the cavity of the box shaped member, the ridges facilitate centering the lower end of the spray bottle inside the boxed shaped member.

The box shaped member also includes a locking feature 835 for securing a bottle within the cavity of the cap (as illustrated in FIG. 10). The locking feature includes a U-shaped cutout 840 defining a tongue 845 that is in line with the planar surface of a side of the box shaped member. The tongue has a wedge 850 that is setback from a tip 855 of the tongue and disposed on the outside surface of the tongue. The wedge has a front end 860 opposing a rear end 865. The rear end of the tongue protrudes perpendicularly outward from the surface of the tongue and the front end of the tongue is slanted towards the rear end forming a triangular wedge shape. The box shaped member is formed from a resilient material such that the tongue of the box shaped member may move inward toward the inside of the box shaped member when forces acting perpendicular to the surface of the tongue are applied to the tongue. The resilient material also allows the tongue to return its original position in line with the plane of the side of the box shaped member when such perpendicular forces are removed.

Figure 9A:
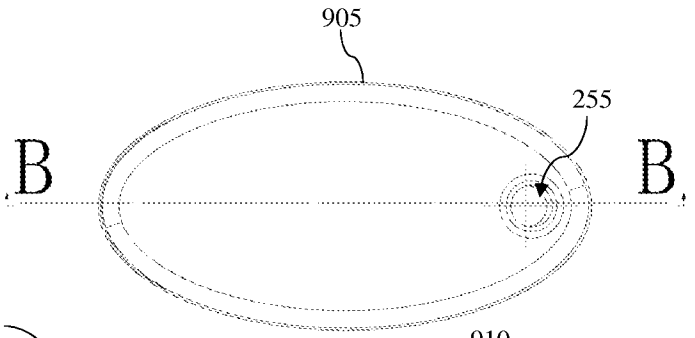
FIG. 9A is a top view of the cap of the device, in accordance with one embodiment of the present invention.
Figure 9B:
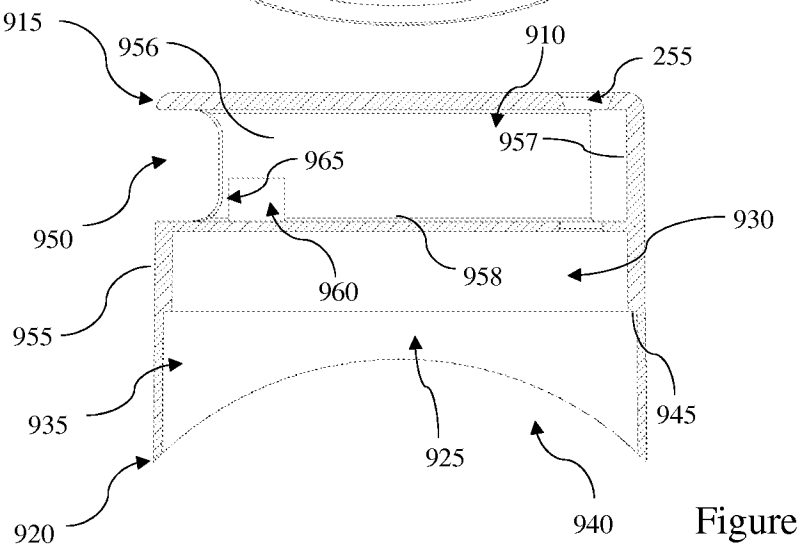
FIG. 9B is a cross-sectional side view of the cap of the device, in accordance with one embodiment of the present invention.

FIG. 9A is a top view of the cap, in accordance with one embodiment of the present invention. FIG. 9B is a cross-sectional side view of the cap 120 along line B of FIG. 9A, in accordance with one embodiment of the present invention. The cap defines an elliptically shaped body 905 having a top end 915 opposing a bottom end 920. The bottom end of the cap defines a mouth 925 that is adapted for receiving an upper portion 140 of the container. In other embodiments (not shown), other geometric shapes for the cap, such as a rectangle, cylinder, a polygon, triangle etc., may also be used such that it matches and can be received by the upper portion of the container. The mouth has an inner section 930 that is proximate to the rear of the mouth and an outer section 935 that is proximate to the opening of the mouth 940. In the present embodiment, the inner section of the mouth has a cross-sectional diameter slightly smaller than the cross-sectional diameter of the outer section such that a shoulder 945 is defined. The cross-sectional diameter of the outer section is sized so that when the upper portion of the container is inserted into the mouth, the shoulder of the cap may stop the sidewall 301 of the container. The inner section of the mouth is sized to allow a portion of a deodorant or other solid to be received by the inner section of the mouth when such deodorant extends beyond the sidewall of the container.

As shown in FIG. 9, in the present embodiment the body of the cap further includes a cavity perpendicular to the longitudinal axis of the mouth. In the present embodiment, the shape of the cavity is adapted to receive and hold the fully assembled spray bottle assembly 605. In the present embodiment, the fully assembled spray bottle assembly is inserted into the cavity such that the longitudinal axis of the spray bottle is perpendicular to the longitudinal axis of the cap. In other embodiments (not shown), the fully assembled spray bottle assembly may be designed such that when inserted into the cavity the longitudinal axis of the spray bottle is coaxial with the longitudinal axis of the cap. The cavity is defined by an opening 950 along a portion of the side 955 of the cap, cavity side walls 956, back wall 957 and bottom wall 958. Proximate to the opening of the cavity of the cap along the cavity wall is an orifice 960. In the present embodiment, the orifice is a rectangular shape. However, other shapes may be used. The orifice has as a rear wall 965 proximate to the opening of the cavity. The cap also includes a spray opening 255 that provides access between the outside and inside of the cavity of the cap and sized to allow fluid to exit the cap. In the present embodiment, the spray opening is circular in shape, however other shapes may also be used.

Figure 10A:
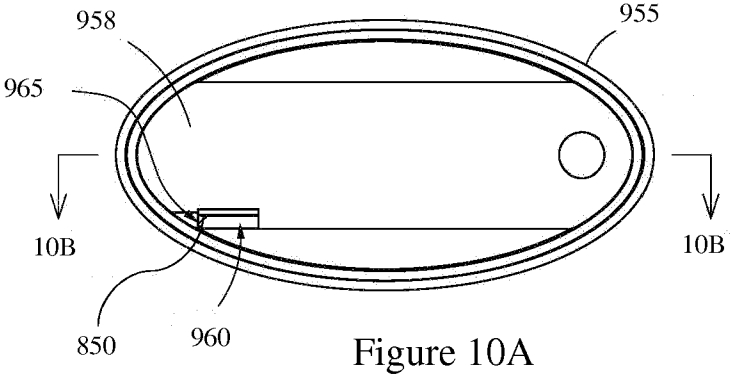
FIG. 10A is a bottom view of the cap of the device having a spray bottle therein, in accordance with one embodiment of the present invention.
Figure 10B:
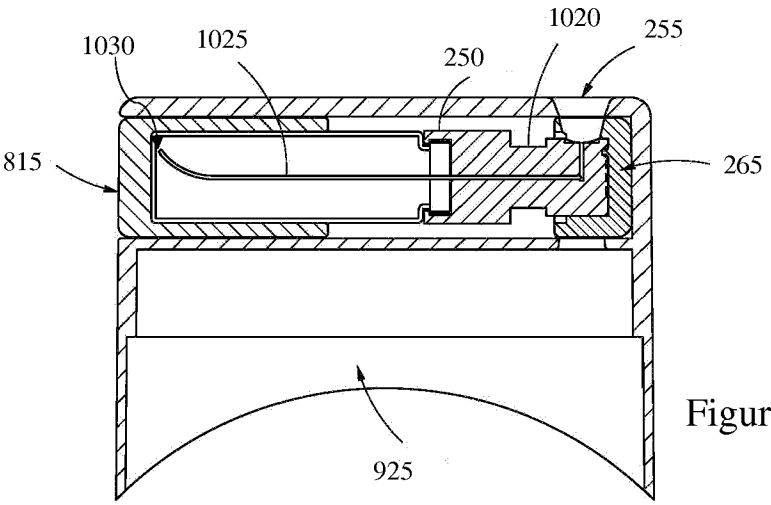
FIG. 10B is a cross-sectional side view of the cap of the device having a spray bottle therein, in accordance with one embodiment of the present invention.

FIG. 10A is a bottom view of the cap having the fully assembled spray bottle assembly inserted therein, in accordance with one embodiment of the present invention. FIG. 10B is a cross-sectional side view along line 10B of FIG. 10A, in accordance with one embodiment of the present invention. FIG. 10A, illustrates the outside of the bottom wall 958 of the cavity. Also illustrated is the orifice 960 having a rear wall 965. As shown in FIG. 10A, when the fully assembled spray bottle assembly has been inserted into the cavity, the rear end of the wedge 850 of the tongue abuts the rear wall of the orifice preventing the fully assembled bottle assembly from being removed. To remove the spray bottle, forces acting toward the inside of the box shaped member along the wedge 850 of the tongue must move the tongue inward such that the wedge clears the rear wall 965 of the orifice 960. When the wedge clears the rear wall, the box-shaped member can be removed as well as the other components of the spray bottle assembly. After the spray bottle assembly is removed, the spray bottle can be replaced or refilled depending of the type of bottle used.

FIG. 10A also illustrates the fully assembled spray bottle assembly inserted into the cavity of the cap in an un-pressed position. In this position, the bottom end 815 of the box shaped member is substantially flush with the opening 950 of the cavity of the cap. As mentioned above, the spray bottle used can be one well known to those skilled in the art. The spray bottle includes a vaporizing mechanism, sprayer, or atomizer that is adapted to face the spray opening 255 of the spray bottle. However, other means by which the liquid inside of the bottle can be moved to outside of the bottle may be used. In one embodiment, the mechanism for dispensing liquid can be a pump that is adapted to take a liquid from inside the bottle to outside of the bottle. The vaporizing mechanism comprises an elongated tube 1025 that is placed inside the spray bottle so that an opening 1030 through which liquid is drawn is proximate to the bottom or lower end of inside the spray bottle. The vaporizing mechanism further includes a check valve (not shown) that is a one-way valve having a hollow stem 1020, wherein the check valve is adapted to allow fluid to pass through the stem when the stem is forced inward or towards the bottom end of the spray bottle. The stem can be forced downward when forces acting along the longitudinal axis of the bottle towards the bottom or lower end of the bottle are applied thereto. Without such forces acting along the longitudinal axis of the bottle, the stem remains in a fully extended position (as shown in FIG. 10B) due to a small compression spring (not shown) that it is placed within the check valve and co-axially aligned with the longitudinal axis of the bottle.

Figure 11A:
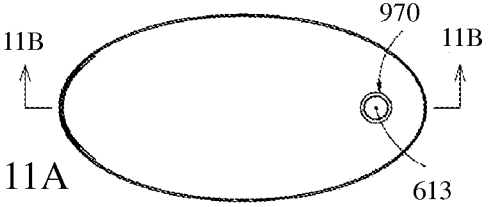
FIG. 11A is a top view of the fully assembled device having a spray bottle therein, in accordance with one embodiment of the present invention.
Figure 11B:
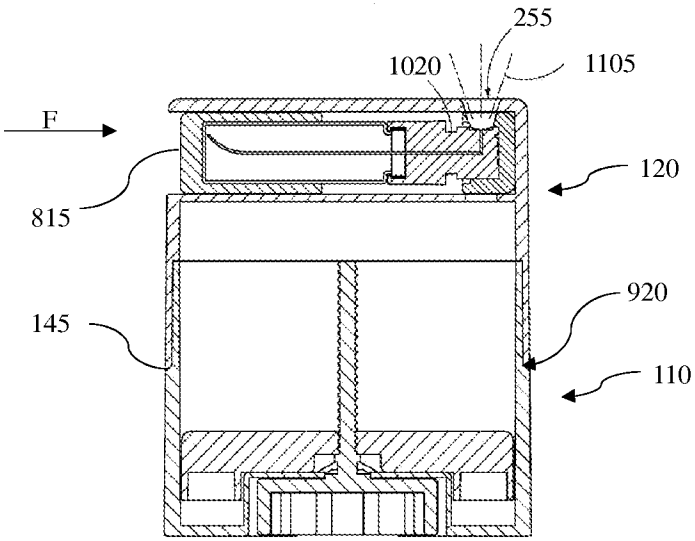
FIG. 11B is a cross-sectional side view of the fully assembled device having a spray bottle therein, in accordance with one embodiment of the present invention.

FIG. 11A is a top view of the fully assembled device having a spray bottle therein, in accordance with one embodiment of the present invention. FIG. 11B is a cross-sectional side view of the fully assembled device having a spray bottle therein. FIG. 11B is a cross-sectional view taken along line 11B of FIG. 11A. FIG. 11B illustrates the cap 120 being received by the container 110 such that the bottom end 920 of the cap sits on the shoulder 145 of the container. In FIG. 11B, inward forces along the spray bottle's longitudinal axis (in the direction of line F) have been applied on the bottom end 815 of the box shaped member. Such force compressed the spring (not shown) within the spray bottle and moved the stem 1020 inward causing the fluid 1105 to exit the spray hole 613 of the spray bottle and held through the spray opening of the cap. After such forces acting on the bottom end of the box shaped member have been removed, then the spring (not shown) decompresses, causing the stem 1020 to extend and moving the spray bottle back to the fully extended or un-pressed position (as shown in FIG. 10B).

FIG. 11B does not show deodorant within the compartment of the container. However, it should be understood that, as explained above, a deodorant, cream, solid, colloid, etc. can be inserted into and held by the compartment.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

We claim:

1. A device adapted for dispensing a substance and a liquid comprising:

a container having a top end opposing a bottom end, wherein the top end comprises an opening and the bottom end defines a bottom wall, the container defining a compartment adapted to receive a substance, wherein an upper portion of the container is the adapted to be covered by a cap;

a cap having a mouth adapted for receiving the upper portion of the container, a cavity adapted to receive a spray bottle, and a spray opening adapted to allow fluid to pass through the cap;

a spray bottle, wherein the spray bottle is adapted to be received by and held within the cavity of the cap and wherein the spray bottle is adapted to spray a fluid through a spray hole; and a lifting device comprising:

a lead-screw comprising a shaft having a first end opposing a second end, wherein the first end of the lead-screw is affixed to a knob, wherein the shaft of the lead-screw further defines a ridge between a threaded portion having a plurality of threads and an unthreaded portion;

an array of cantilevers defining a ring feature surrounding an opening in a recess of the bottom wall of the container, wherein the ring feature is adapted to secure the lead-screw and allow the lead-screw to rotate within the compartment; and, a substantially planar lift body adapted to fit within the compartment of the container, wherein the lift body includes a tubular channel through the center of the lift body, wherein the channel has a channel wall having a plurality of threads that corresponds to the threads on the threaded portion of the lead-screw.

2. The device from claim 1, wherein the lift body is movable between an up position and a down position, wherein rotational forces applied to the lead-screw cause the lift body to move between the up position and the down position.

3. The device from claim 2, wherein the lift body is adapted to raise and lower the substance and wherein the substance is a solid.

4. The device from claim 2, wherein the lift body is adapted to lift and lower the substance and wherein the substance is a colloid.

5. The device from claim 1, wherein the spray bottle has an upper end opposing a lower end, wherein a fully assembled spray bottle assembly comprises the upper end of the spray bottle received by a removable crowning member and the lower end of the spray bottle received by a removable box shaped member;

wherein the crowning member comprises a semi-circular shaped hollow body having a curved top end opposing a flat bottom end, said bottom end having a first opening adapted for receiving the upper end of the spray bottle, said semi-circular body further having a side wall having a second opening adapted for allowing a fluid to pass through said side wall; and, wherein the box shaped member has an inside and an outside, wherein the inside of the box shaped member is adapted for receiving the bottom end of the spray bottle, and wherein the box shaped member has a locking feature for securing the fully assembled spray bottle assembly within the cavity of the cap.

6. The device of claim 5, wherein the locking feature comprises a u-shaped cutout defining a tongue in-line within the planar surface of a side of the box shaped member, wherein said tongue has a wedge setback from a tip of the tongue and disposed on an outside surface of said tongue, wherein the wedge has a front end opposing a rear end, wherein the rear end protrudes perpendicularly outward from the outside surface of the tongue and the front end is slanted towards the rear end.

7. The device of claim 6, wherein a wall of the cavity of the cap includes an orifice having an rear wall such that when a fully assembled spray bottle assembly is inserted into the cavity, the wedge of the box shaped member enters into the orifice and the rear end of the wedge is prevented from passing the rear wall of the orifice such that the wedge prevents the fully assembled spray bottle assembly from being removed from the cavity of the cap.

8. The device of claim 7, wherein when the fully assembled spray bottle assembly is inserted into the cavity such that the rear wall of the orifice prevents the wedge of the box shaped member from passing towards the outside of the cap, an inward force applied proximate to the tip of the tongue causes the wedge to be inserted into the orifice such that the wedge clears the rear wall of the orifice allowing the spray bottle assembly to be removed when longitudinal forces acting on the spray bottle assembly move the spray bottle assembly out of the cavity.

9. The device of claim 5, wherein the box shaped member further comprises at least one elongated ridge disposed on the inside of each side of the box shaped member, wherein the elongated ridges are adapted for decreasing movement of the bottom end of the spray bottle when inserted into the box shaped member.

10. The device of claim 5, wherein a top end of the spray bottle includes a depression that is adapted to receive a protrusion on an inside front wall of the crowning member, and wherein the inside front wall of the crowning member includes a protrusion adapted to be received by a depression on the top end of the spray bottle.

11. The device of claim 1, wherein the spray bottle is movable between an un-pressed position and a pressed position, wherein in the un-pressed position a stem of the spray bottle is in a fully extended position, and in the pressed position the stem of the spray bottle is in the fully compressed position, wherein forces acting along the longitudinal axis of the spray bottle cause the spray bottle to move between the pressed and un-pressed position, and wherein the spray bottle emits a fluid thought the spray hole when moving between the un-pressed position to the pressed position.

12. A device adapted to dispense a substance and a liquid comprising:

a container having a top end opposing a bottom end, wherein the top end comprises an opening and the bottom end defines a bottom wall, the container defining a compartment adapted to receive a substance, wherein an upper portion of the container is the adapted to be covered by a cap;

a lifting device comprising:

a lead-screw comprising a shaft having a first end opposing a second end, wherein the first end of the lead-screw is affixed to a knob, and wherein the shaft of the lead-screw has a ridge between a threaded portion having a plurality of threads and an unthreaded portion;

an array of cantilevers defining a ring feature surrounding an opening in a recess of the bottom wall of the container, wherein the ring feature is adapted to secure the lead-screw and allow the lead-screw to rotate within the compartment; and, a substantially planar lift body adapted to fit within the container, wherein the lift body includes a tubular channel through the center of the lift body, wherein the channel has a channel wall having a plurality of threads that corresponds to the threads on the threaded portion of the lead-screw;

a cap having a mouth adapted for receiving the upper portion of the container, a cavity adapted to receive a spray bottle, and a spray opening adapted to allow fluid to pass through the said side wall;

a spray bottle, wherein the spray bottle is adapted to be received by and held within the cavity of the cap and wherein the spray bottle is adapted to spray a fluid through a spray hole;

wherein the spray bottle has an upper end opposing a lower end, wherein a fully assembled spray bottle assembly comprises the upper end of the spray bottle received by a removable crowning member and the lower end of the spray bottle being received by a box shaped member;

wherein the crowning member comprises a semi-circular shaped hollow body having a curved top end opposing a flat bottom end, said bottom end having a first opening adapted for receiving the upper end of the spray bottle, said semi-circular body further having a side wall having a second opening adapted for allowing fluid to pass through the side wall of the crowning member; and wherein the box shaped member has an inside and an outside, wherein the inside of the box shaped member is adapted for receiving the bottom end of the spray bottle, and wherein the box shaped member has a locking feature for securing the fully assembled spray bottle assembly within the cavity of the cap.

13. The device from claim 12, wherein the lift body is movable between an up position and a down position, wherein rotational forces applied to the lead-screw cause the lift body to move between the up position and the down position.

14. The device from claim 13, wherein the lift body is adapted to lift and lower the substance and wherein the substance comprises a solid.

15. The device of claim 14, wherein the locking feature comprises a u-shaped cutout defining a tongue in-line within the planar surface of a side wall of the box shaped member, wherein said tongue has a wedge setback from a tip of the tongue and disposed on an outside surface of said tongue, wherein the wedge has a front end opposing a rear end, wherein the rear end protrudes perpendicularly outward from the outside surface of the tongue and the front end is slanted towards the rear end.

16. The device of claim 15, wherein a wall of the cavity of the cap includes an orifice having a rear wall such that when a fully assembled spray bottle assembly is inserted into the cavity, the wedge of the box shaped member enters into the orifice and the rear end of the wedge is prevented from passing the rear wall of the orifice such that the wedge prevents the spray bottle assembly from being removed from the cavity of the cap.

* * * * *